US007730916B2

(12) United States Patent
Carter

(10) Patent No.: US 7,730,916 B2
(45) **Date of Patent: *Jun. 8, 2010**

(54) FOLDING WORK BENCH

(76) Inventor: Mark C. Carter, 20580 Avenida de Arboles, La Cresta, CA (US) 92562

( * ) Notice: Subject to any disclaimer, the term of this patent is extended or adjusted under 35 U.S.C. 154(b) by 0 days.

This patent is subject to a terminal disclaimer.

(21) Appl. No.: 12/509,316

(22) Filed: Jul. 24, 2009

(65) Prior Publication Data

US 2009/0283180 A1 Nov. 19, 2009

Related U.S. Application Data

(60) Continuation of application No. 12/028,293, filed on Feb. 8, 2008, now Pat. No. 7,565,922, which is a division of application No. 11/441,792, filed on May 25, 2006, now Pat. No. 7,350,549.

(60) Provisional application No. 60/685,826, filed on May 31, 2005.

(51) Int. Cl.
*B25H 1/00* (2006.01)

(52) U.S. Cl. ..... 144/286.1; 144/286.5

(58) Field of Classification Search ..... 144/286.1, 144/286.5, 287; 108/115, 126, 134, 160, 108/170, 175, 125, 162, 176, 186
See application file for complete search history.

(56) References Cited

U.S. PATENT DOCUMENTS

| | | | |
|---|---|---|---|
| 1,027,012 | A | 5/1912 | Stock et al. |
| 1,420,206 | A | 6/1922 | Milam |
| 1,459,930 | A | 6/1923 | Riehle |
| 1,498,319 | A | 6/1924 | Dexter |
| 1,642,687 | A | 9/1927 | Morris |
| 1,678,378 | A | 7/1928 | Campbell |
| 1,688,533 | A | 10/1928 | Eger |
| 2,505,658 | A | 4/1950 | Wilson |
| 2,580,618 | A | 1/1952 | Terrell |
| 2,646,330 | A | 7/1953 | Swainbank |
| 3,381,998 | A | 5/1968 | Cheshier et al. |
| 3,394,666 | A | 7/1968 | Pearlman |
| 4,155,609 | A | 5/1979 | Skafte et al. |
| 4,313,385 | A | 2/1982 | Fitzgerald |
| 4,341,164 | A | 7/1982 | Johnson |
| 4,415,149 | A | 11/1983 | Rees |
| 5,067,535 | A | 11/1991 | Wolff |
| 5,170,719 | A | 12/1992 | Pestone |

(Continued)

OTHER PUBLICATIONS

STOR-TITE, "The Ultimate Solution for Limited Workspaces," web page hhtp://custom-manufactured-products.com, p. 1-May 27, 2005.

(Continued)

*Primary Examiner*—Shelley Self
(74) *Attorney, Agent, or Firm*—Fulwider Patton LLP

(57) ABSTRACT

The folding work bench folds compactly for storage when not in use and occupies a minimal work space. The folding work bench has a durable work surface, a top storage shelf, a back board for hanging tools, a locking mechanism, and a work table that can be folded up against the back board and locked in a compactly folded configuration that also secures the tools on the back board in the work bench.

9 Claims, 15 Drawing Sheets

U.S. PATENT DOCUMENTS

| | | | | |
|---|---|---|---|---|
| 5,819,670 | A | 10/1998 | O'Connor et al. | |
| 6,460,442 | B2 | 10/2002 | Talesky et al. | |
| 6,786,162 | B1 | 9/2004 | Volkmer et al. | |
| 6,811,233 | B1 | 11/2004 | Packer | |
| 7,044,178 | B1 | 5/2006 | Campbell | |
| 7,350,549 | B2 | 4/2008 | Carter | |
| 7,540,312 | B2 * | 6/2009 | Carter | 144/286.5 |
| 7,565,922 | B2 * | 7/2009 | Carter | 144/286.1 |

OTHER PUBLICATIONS

Frontgate, "Double Fold-Away Workbench," web page http://amos.shop.com/cc.amos?main=catalog&prd=14353476& x Front &ccsyn=260&pcd=9354425&ccsid=403768747-1847, p. 1-May 27, 2005.

* cited by examiner

FIG. 7
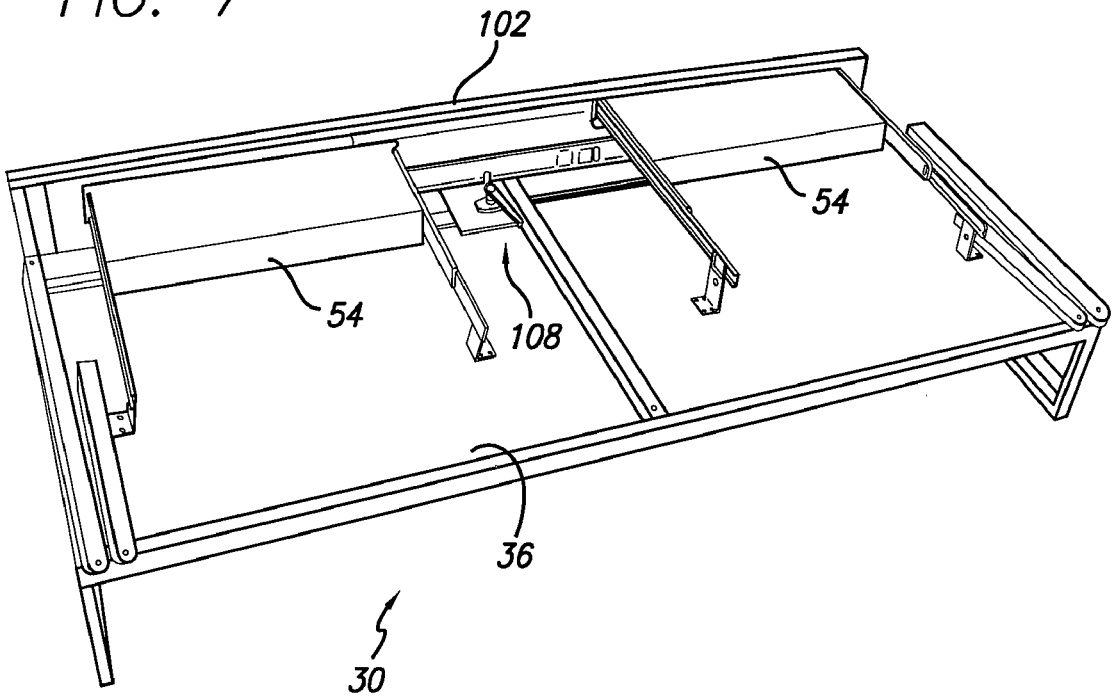
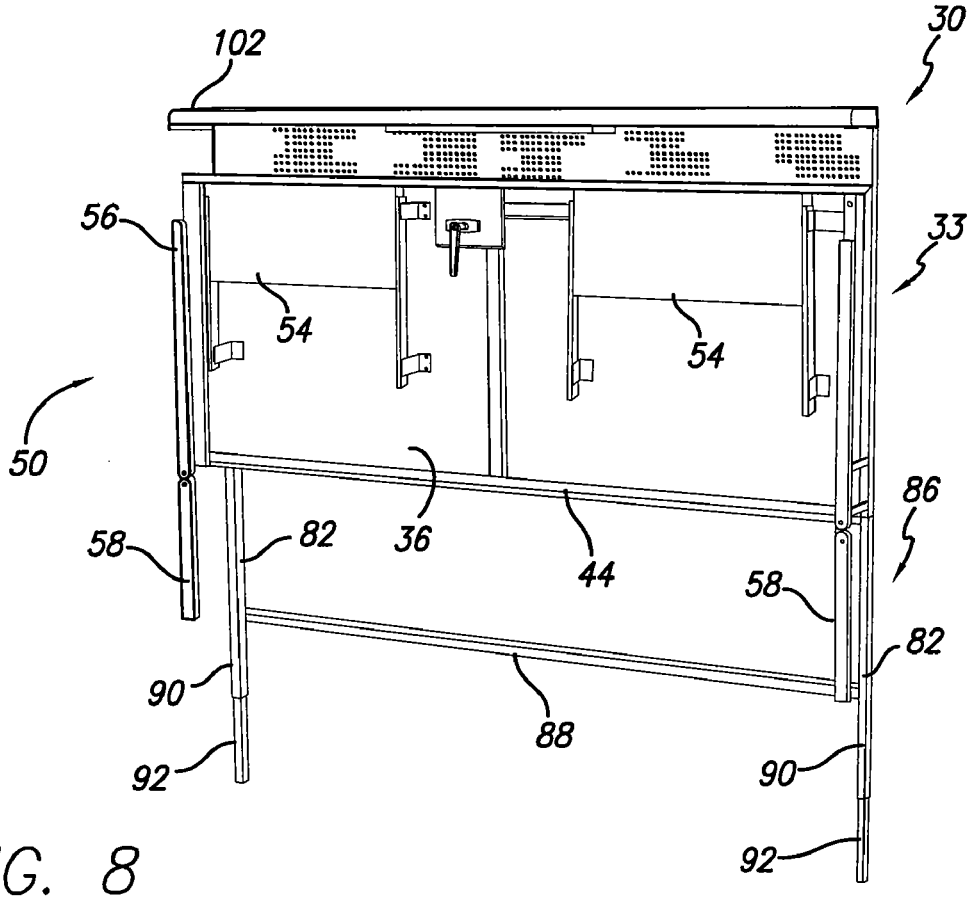
FIG. 8

FOLDING WORK BENCH

CROSS-REFERENCES TO RELATED APPLICATIONS

This application is a continuation of application Ser. No. 12/028,293, filed Feb. 8, 2008, now U.S. Pat. No. 7,565,922, which is a divisional of application Ser. No. 11/441,792, filed May 25, 2006, now U.S. Pat. No. 7,350,549, which is based upon provisional application No. 60/685,826, filed May 31, 2005.

BACKGROUND

1. Field of the Invention

This invention relates to work benches, and more particularly relates to a folding work bench movable between a folded configuration or partially folded configuration for convenient space-saving storage, and an unfolded configuration to provide a working surface and work space with ready access to a user's tools.

2. General Background and State of the Art

Many home owners have limited work shop or garage space for home repair projects and home construction projects. Typical home work shop work benches are permanent structures occupying a constant amount of space whether in use or not, and having places for storage of tools for ready access for use at the work bench. In such crowded work shop or garage spaces, it would be desirable to store the work bench and tools in a smaller space when not in use. Hooks of various sorts are often provided for hanging tools for ready access, but such tools are also typically not securable against theft when the work bench area is not in use, and it would be desirable to provide a way of securing such a work bench collection of tools against theft when the work bench area is not in use. The present invention satisfies these and other needs.

SUMMARY OF THE INVENTION

Briefly, and in general terms, the invention provides for a folding work bench that folds compactly for storage, such as in a storage box in a folded configuration or against a wall in a partially folded configuration, when not in use. The folding work bench occupies a minimal work space, allowing a work shop area in garage or basement to be utilized for other purposes as well. The folding work bench has a durable work table with a work surface, a top storage shelf, a back board member for hanging tools, and a locking mechanism. The work table can be folded up against the back board member and locked in a compactly folded configuration that also secures tools placed on the back board member within the folded work bench.

The present invention accordingly provides for a folding work bench movable between a folded configuration or partially folded configuration and an unfolded configuration. In one presently preferred embodiment, the folding work bench includes a generally planar work table having a top work surface, which is movable between a folded position extending in a longitudinal direction in the folded configuration and an unfolded position extending in a transverse direction substantially perpendicular to the longitudinal direction in the unfolded configuration. The work table typically has a durable top work surface, such as a laminated wood work surface, for example, and optionally may also include one or more sliding drawers mounted to the underside of the work table.

A plurality of front legs are pivotally connected to the front side of the work table, so as to be compactly foldable against the underside of the work table in the folded or partially folded configuration. The folding work bench typically has a pair of front legs, which optionally may include bottom folding end pieces, and which optionally may be connected together by a cross-brace.

The folding work bench includes a generally planar back board member extending in the longitudinal direction in the folded and unfolded configurations, which includes a pair of first support struts and a pair of second support struts mounted to the bottom side of the back board member. The pair of first support struts extend downwardly in the longitudinal direction from the bottom side of the back board member. The pair of second support struts extend in the transverse direction from the bottom side of the back board member and are pivotally connected to the left and right sides of the work table. In a presently preferred aspect, the back board member is a peg board for holding tools, and typically is a steel peg board.

A plurality of rear legs, typically a pair of legs, are pivotally connected to the pair of first support struts, and are movable between an upwardly folded position extending in the longitudinal direction adjacent to the back board member and a downwardly unfolded position extending downwardly from the pair of first support struts in the longitudinal direction for supporting the folding work bench. The folding work bench can assume a partially folded configuration in which the rear legs are unfolded to support the folding work bench with the work table and front legs in their folded positions, so that the folding work bench can be stored in the partially folded configuration in a standing position against a wall, ready to be unfolded for use. The rear legs optionally may include telescoping end pieces, and optionally may also be connected by a cross brace.

In a presently preferred aspect, the folding work bench includes one or more articulated struts having first and second links pivotally connected together. The folding work bench typically includes a pair of the articulated struts. For each articulated strut, the first link is pivotally connected to a front leg, and the second link is connected to one of the first support struts. The articulated struts extend in the transverse direction in the unfolded configuration, and extend in the longitudinal direction in the folded configuration.

The folding work bench advantageously preferably includes a top storage shelf mounted to the top side of the back board member and extending in the transverse direction from the back board member. The top storage shelf optionally may include a fluorescent light mounted to the underside of the top storage shelf, and optionally may include an electrical outlet on the underside of the top storage shelf.

In another presently preferred aspect, the folding work bench includes a locking device for locking the work table in a folded position. The locking device typically includes a pair of opposing locking pins connected to a locking handle. By turning the locking handle, the locking pins can be moved between an inwardly withdrawn unlocking position and an outwardly extending locking position. A pair of locking struts are mounted on opposing sides of the back board member and extend in the transverse direction toward the front of the folding work bench, and each of the opposing locking struts includes an aperture for receiving the locking pins when the locking pins are in their outwardly extending locking position. In this manner, tools on the back board member may be locked inside the folding work bench.

In another presently preferred embodiment, the present invention provides for a folding work bench movable between a folded configuration or partially folded configuration and an unfolded configuration, including a generally planar work table movable between a folded position and an unfolded position, a plurality of front legs slidably connected to the table member so as to be slidable between the front and rear sides of the table member, a plurality of rear legs pivotally connected to the rear side of the table member, and a generally planar back board member slidably connected to the plurality of rear legs. In a presently preferred aspect, the front legs are pivotally connected to the rear legs by a truss assembly of link members pivotally connected together. The table top member may include one or more sliding drawers, and a top storage shelf is typically mounted to the top side of the back board member.

Other features and advantages of the present invention will become more apparent from the following detailed description of the preferred embodiments in conjunction with the accompanying drawings, which illustrate, by way of example, the operation of the invention.

BRIEF DESCRIPTION OF THE DRAWINGS

FIG. 7 is a bottom perspective view of a variation of the folding work bench of FIG. 1 in the folded configuration, in which like elements are identified with like reference numbers.

FIG. 8 is a perspective view of the folding work bench of FIG. 7, shown in a partially folded configuration with the rear legs in an unfolded position and the work table and front legs in folded positions, with tools placed on the back board member.

DETAILED DESCRIPTION OF THE PREFERRED EMBODIMENTS

Figure 1:
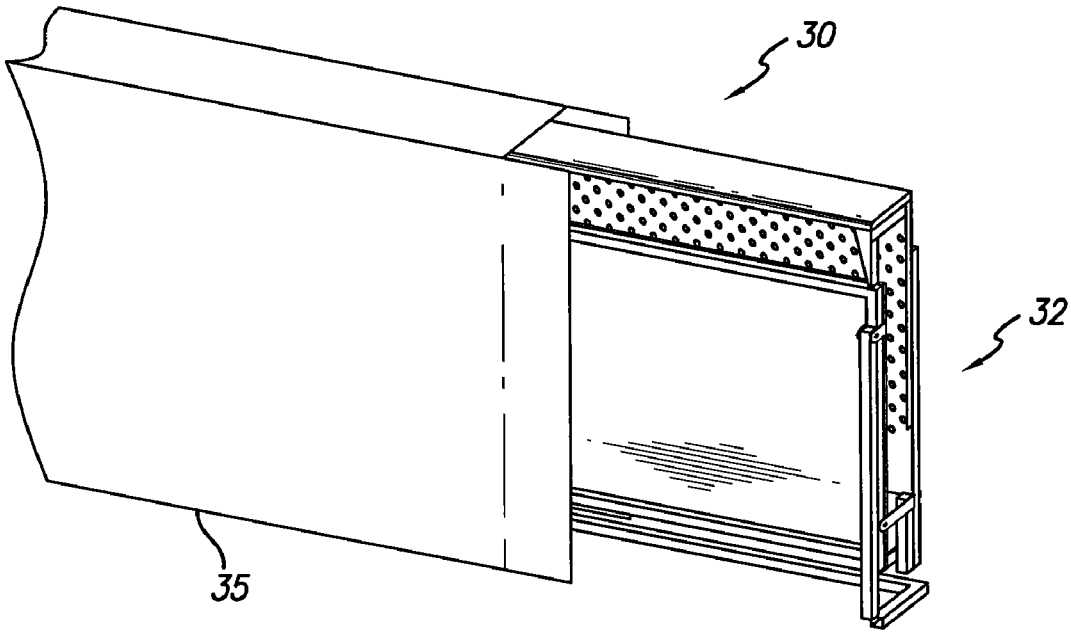
FIG. 1 is a perspective view of a first preferred embodiment of the folding work bench in a folded configuration being removed from a storage box, according to the present invention.
Figure 2:
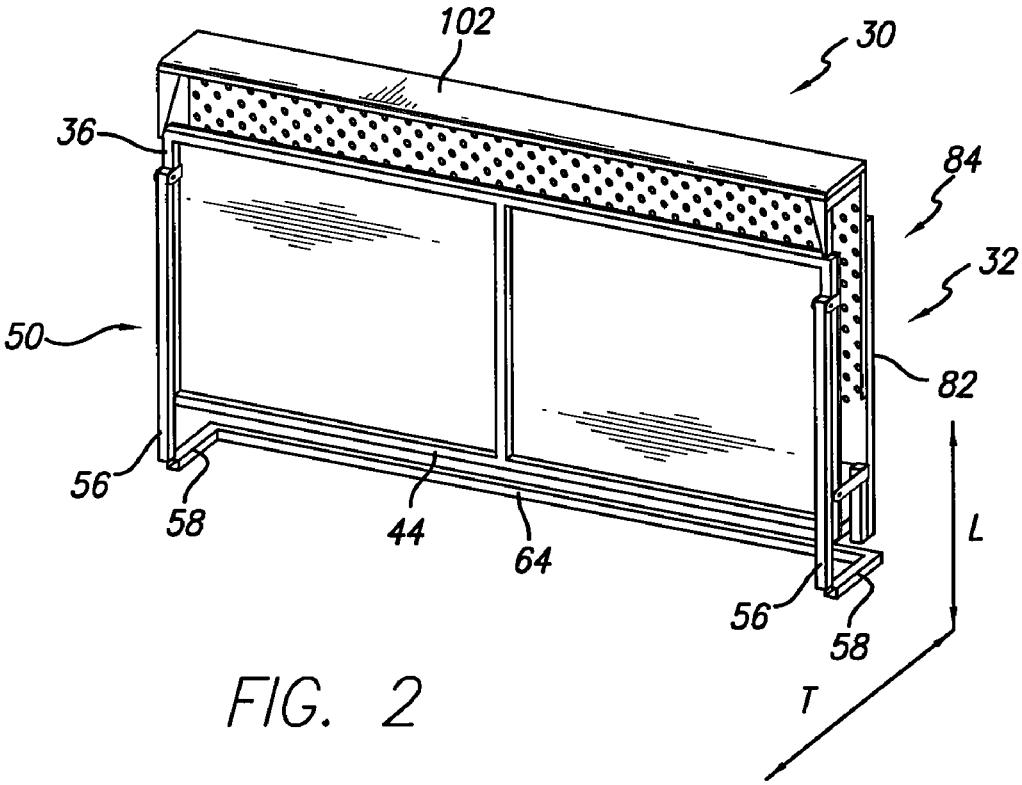
FIG. 2 is a perspective of the folding work bench of FIG. 1 in the folded configuration.
Figure 3:
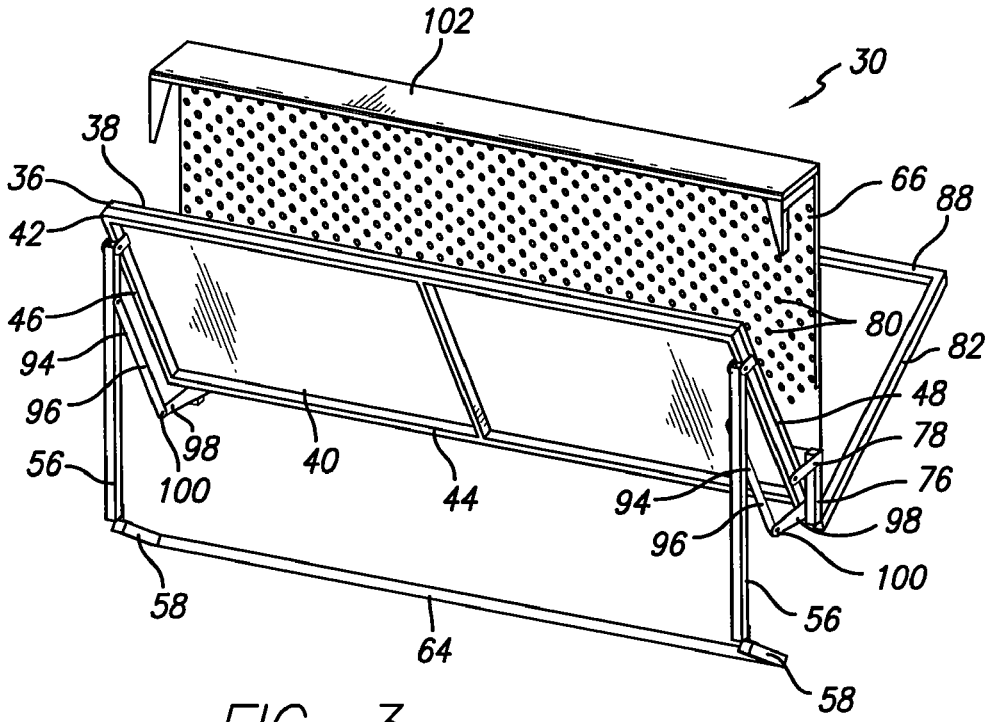
FIG. 3 is a perspective view of the folding work bench of FIG. 1 illustrating the unfolding of the folding work bench from the folded configuration.
Figure 4:
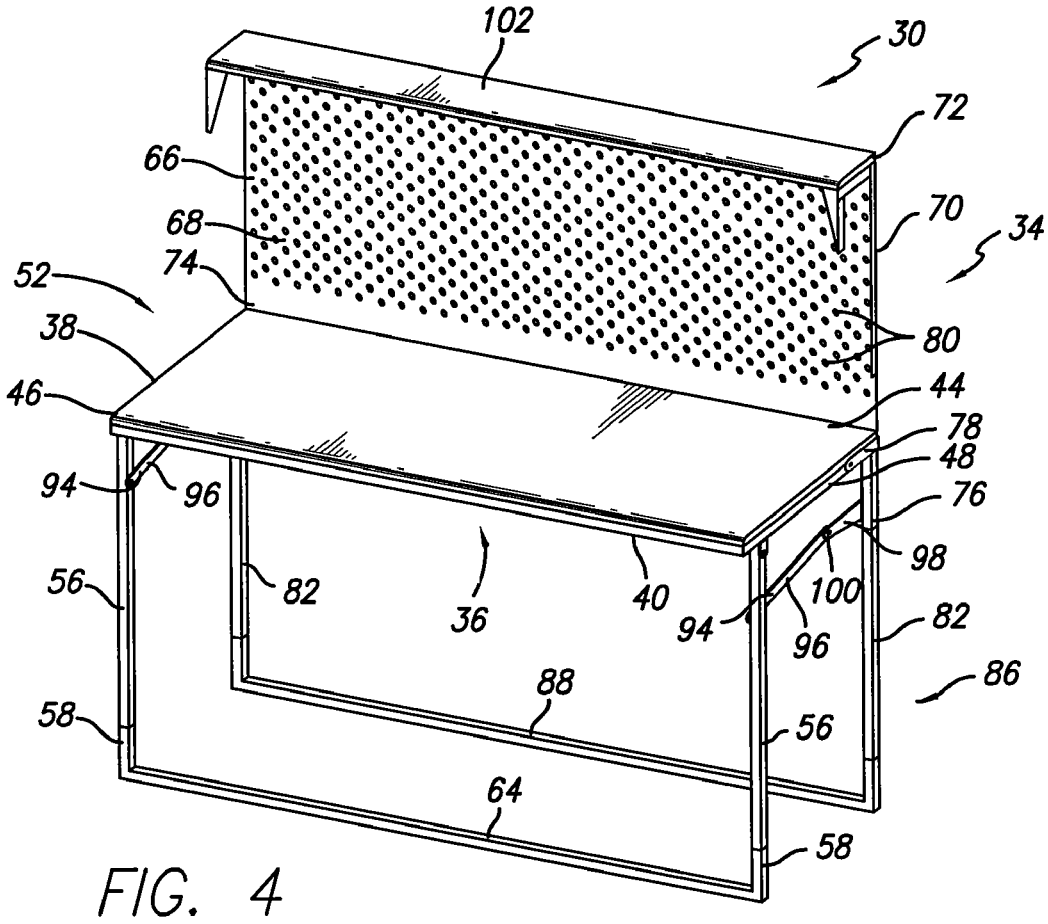
FIG. 4 is a perspective view of the folding work bench of FIG. 1 in an unfolded configuration.
Figure 5:
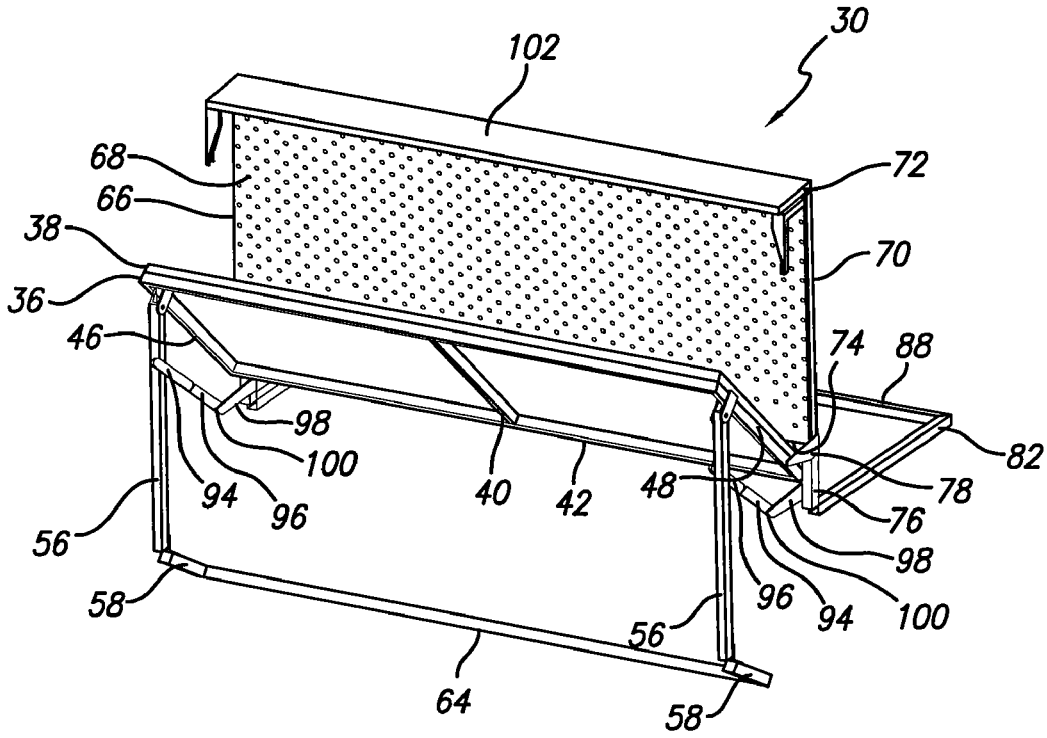
FIG. 5 is a perspective view of the folding work bench of FIG. 1 illustrating the folding of the folding work bench from the unfolded configuration.
Figure 6:
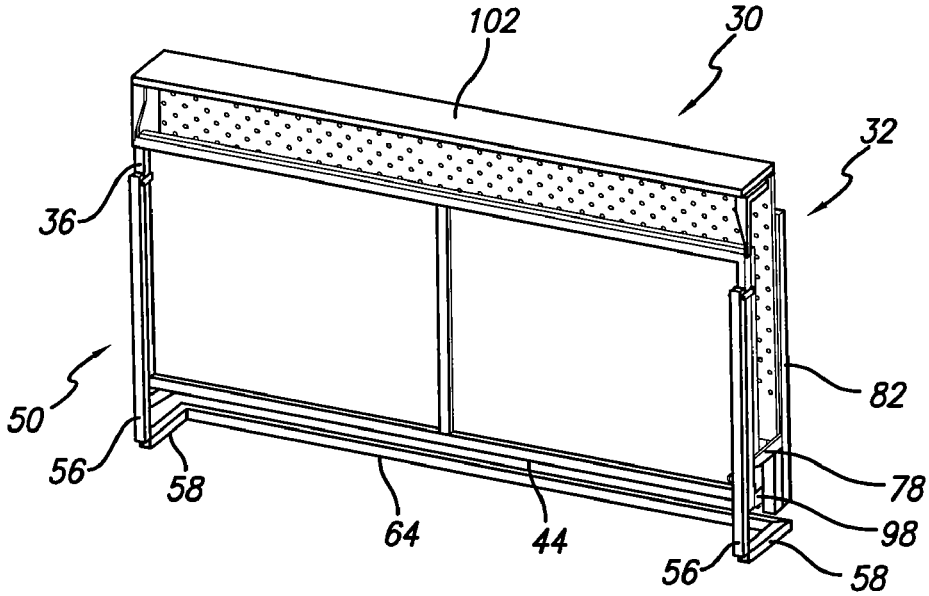
FIG. 6 is a perspective view of the folding work bench of FIG. 1 in a folded configuration ready to be placed in a storage box, according to the present invention.
Figure 9:
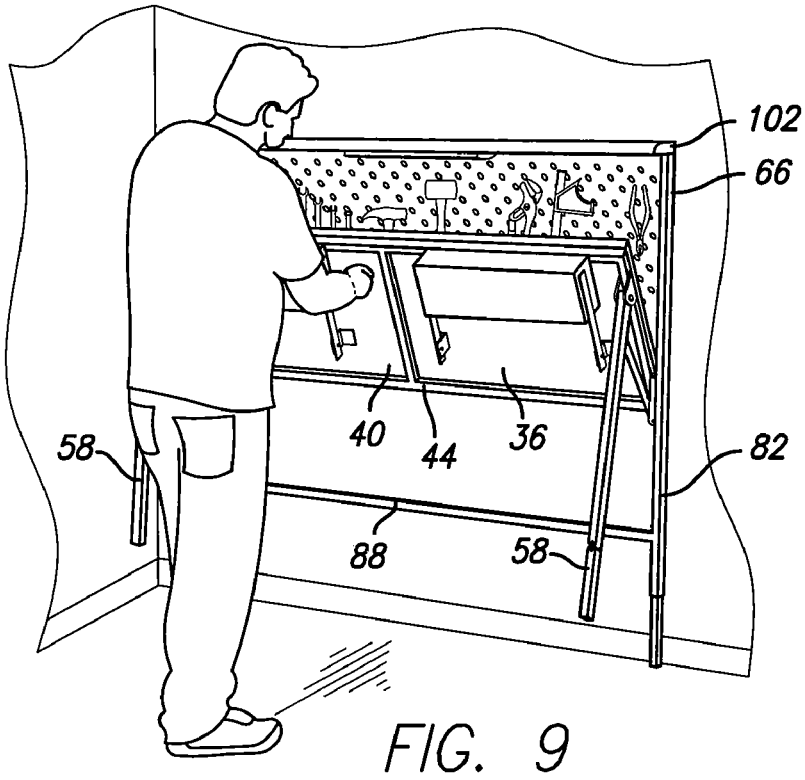
FIG. 9 is a perspective view of the folding work bench of FIG. 7 illustrating the unfolding of the folding work bench from the partially folded configuration, with tools placed on the back board member.
Figure 10:
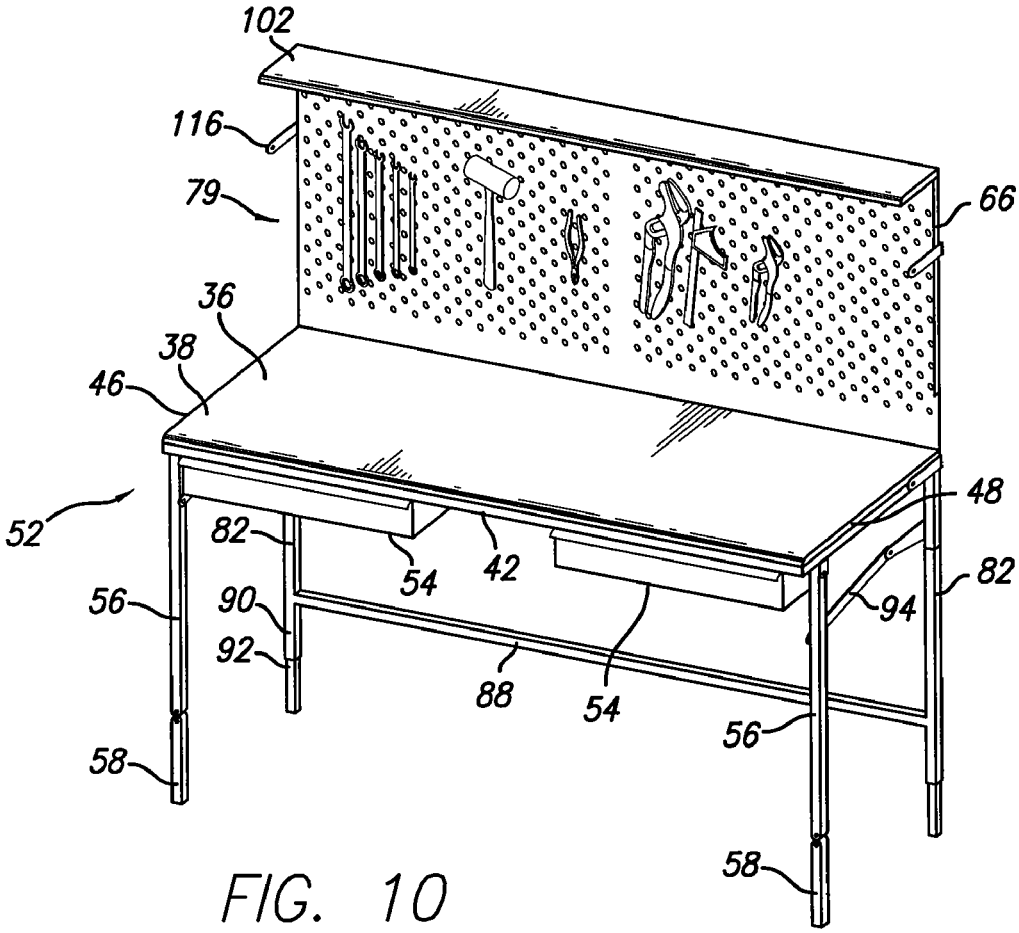
FIG. 10 is a perspective view of the folding work bench of FIG. 7 with tools placed on the back board member in an unfolded configuration.
Figure 12:
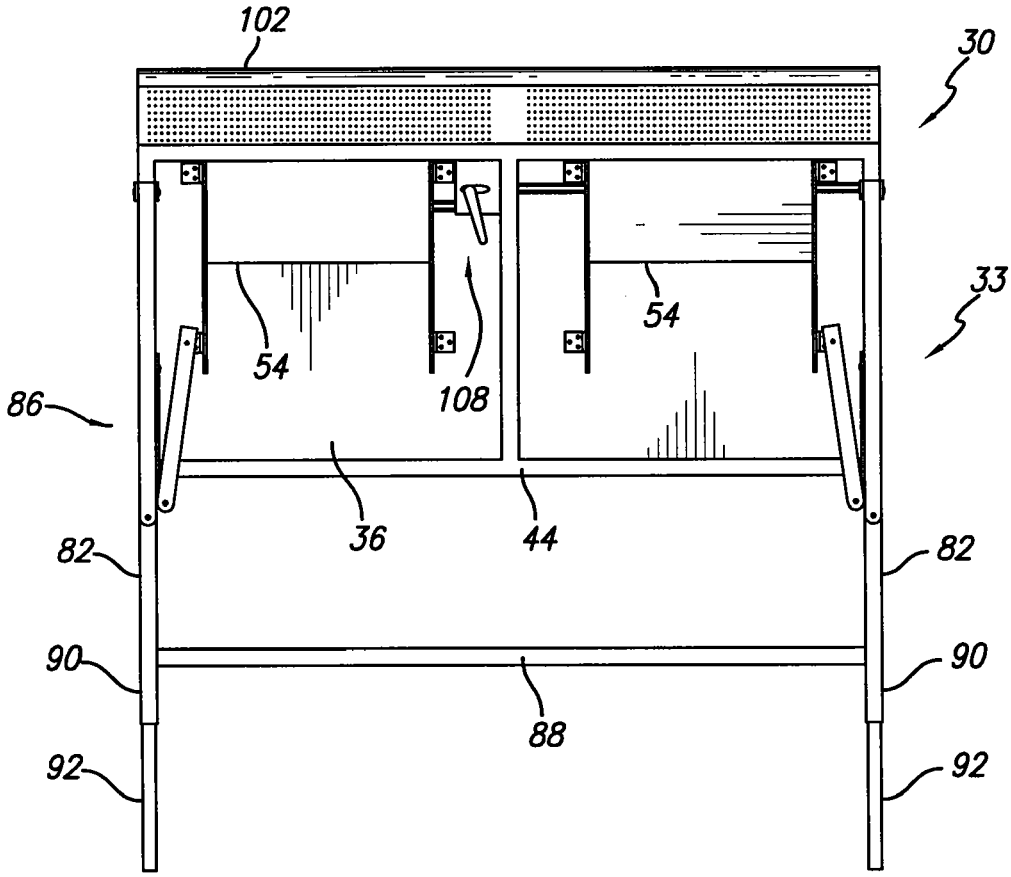
FIG. 12 is a front view of the folding work bench of FIG. 7 in the partially folded configuration.
Figure 13:
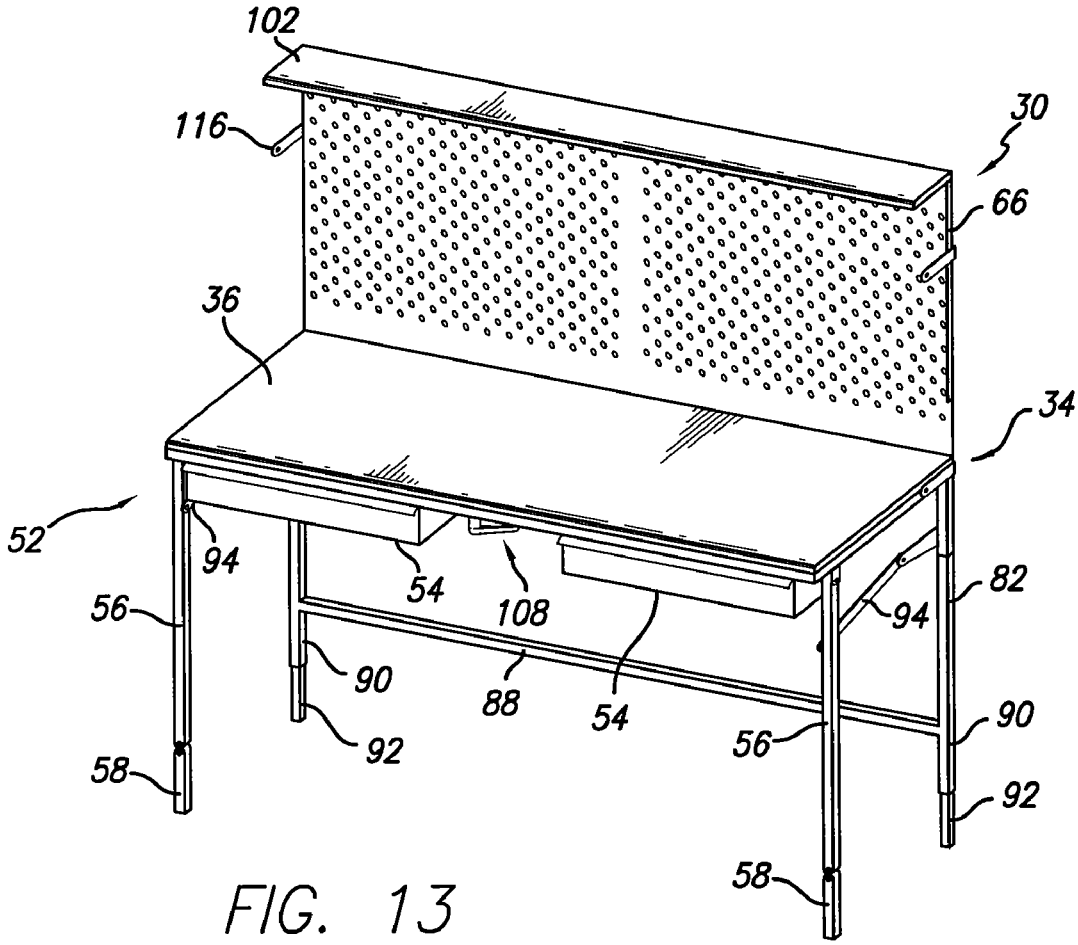
FIG. 13 is a perspective view of the folding work bench of FIG. 7 in an unfolded configuration.
Figure 14:
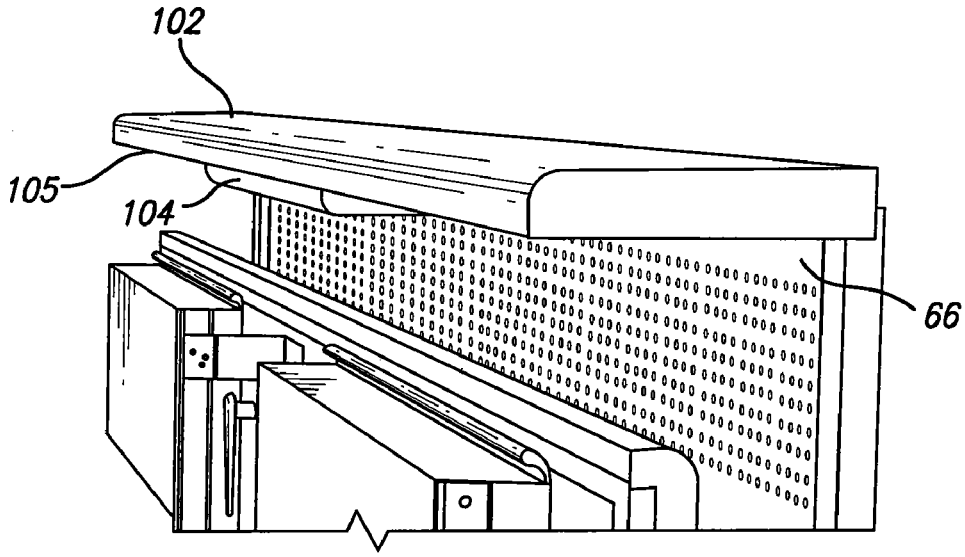
FIG. 14 is a perspective view of the top storage shelf of the folding work bench of FIG. 7.
Figure 15:
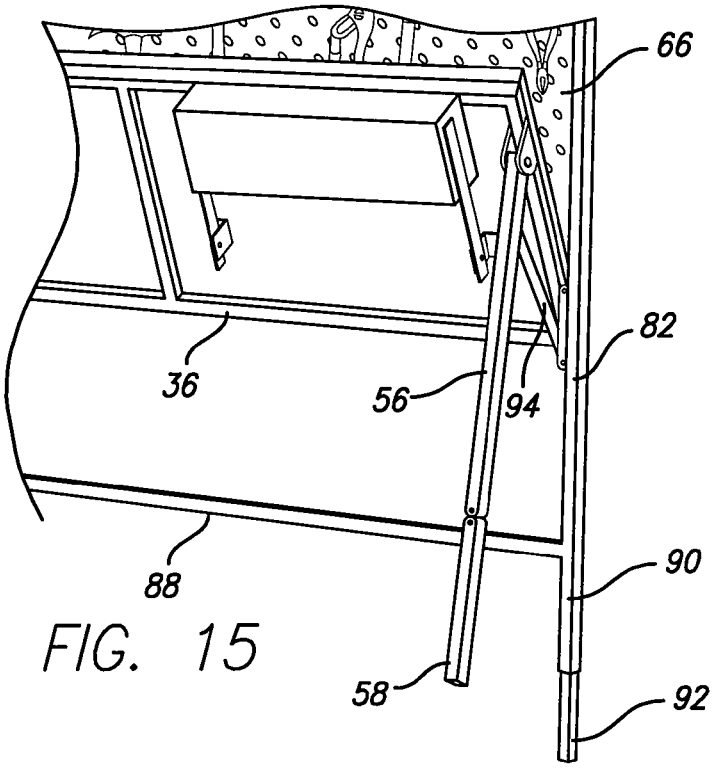
FIG. 15 is an enlarged view of right side articulated strut of the folding work bench of FIG. 7 illustrating the unfolding of the folding work bench from the partially folded configuration.
Figure 16:
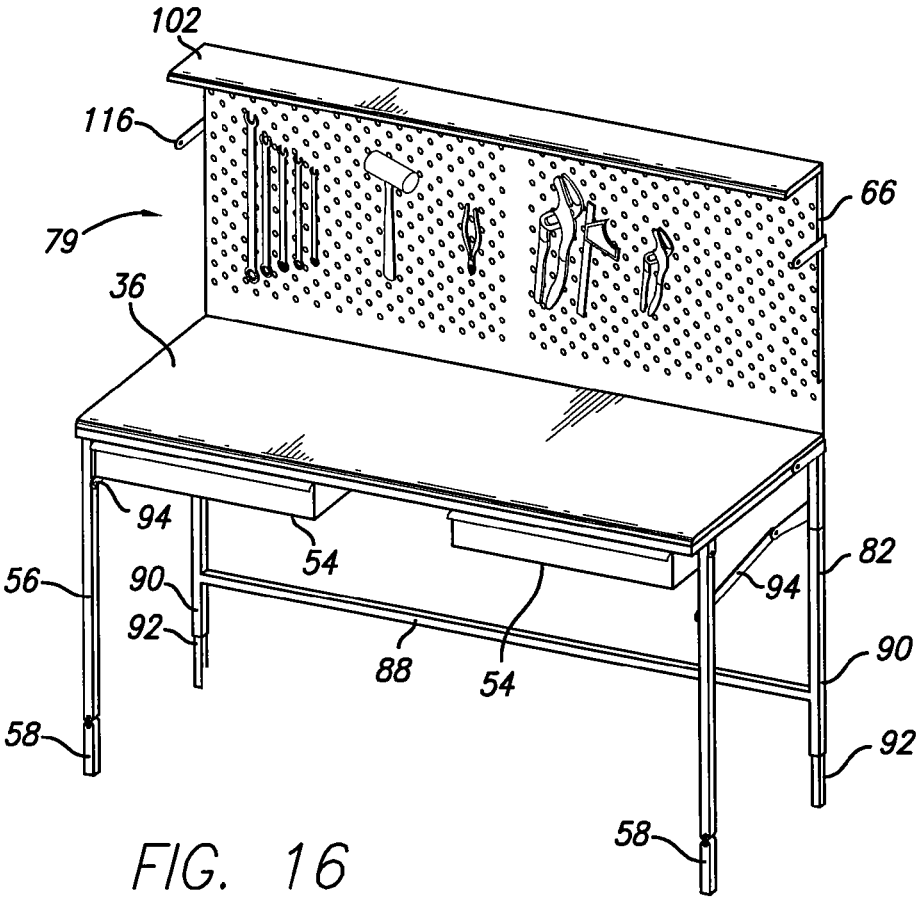
FIG. 16 is a perspective view of the folding work bench of FIG. 7 with tools placed on the back board member in an unfolded configuration.
Figure 17:
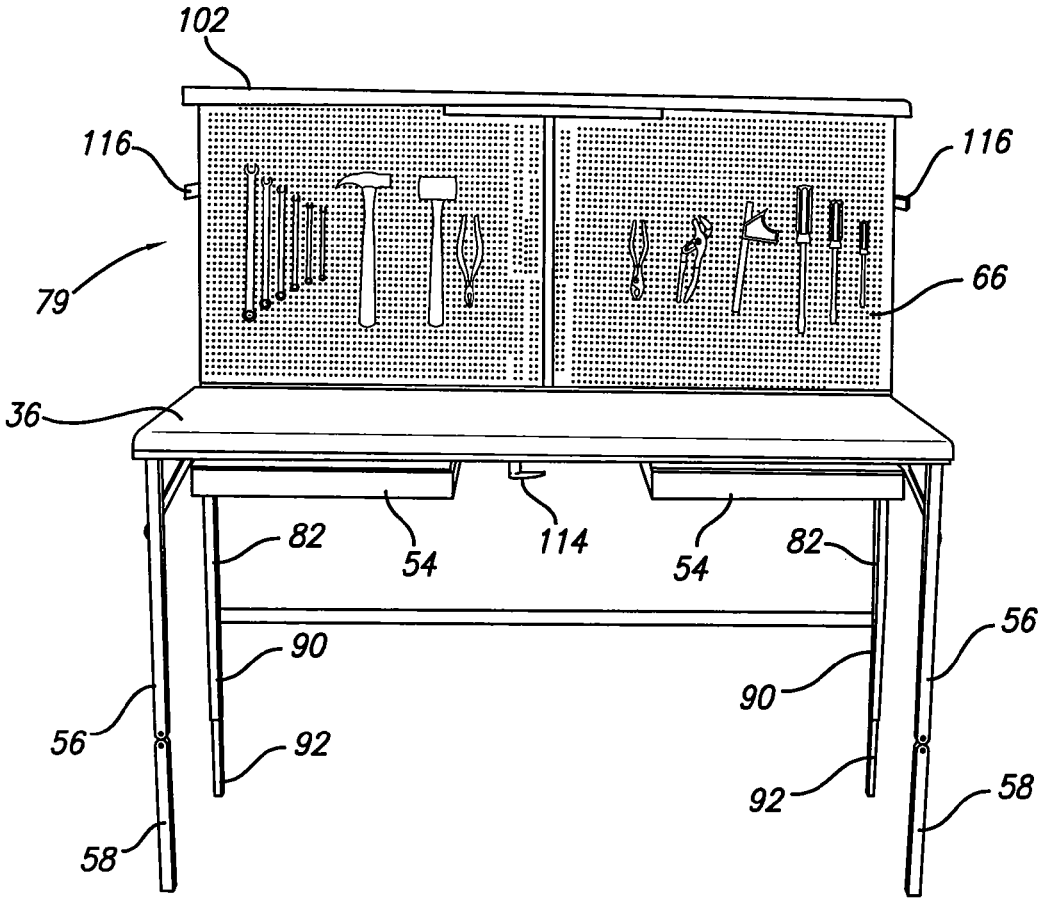
FIG. 17 is a front view of the folding work bench of FIG. 7 with tools placed on the back board member in an unfolded configuration.
Figure 18:
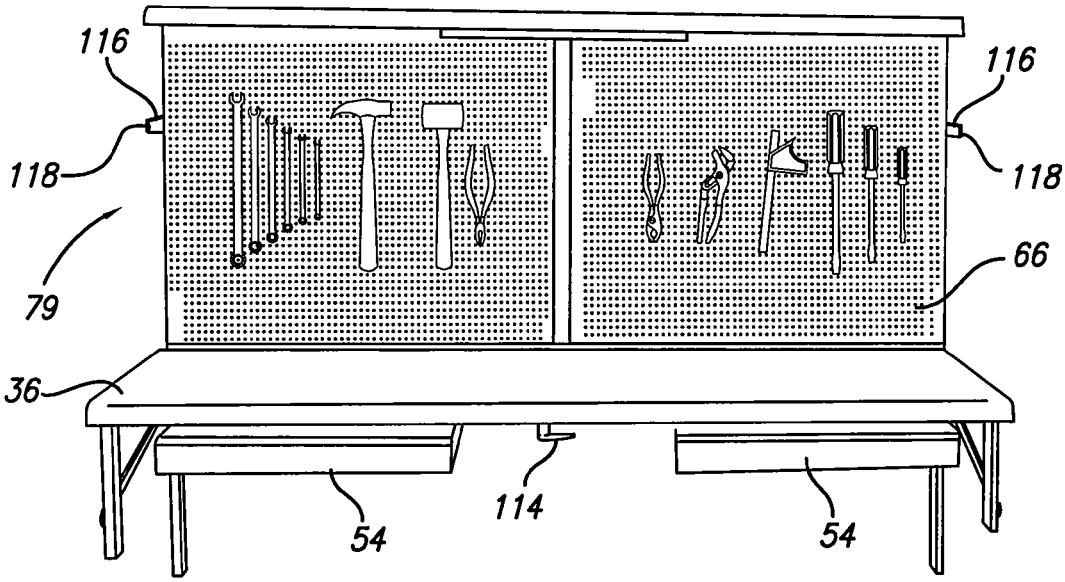
FIG. 18 is an enlarged front view of the back board member of the folding work bench of FIG. 7 with tools placed on the back board member in an unfolded configuration.

Referring to the drawings, which are provided for purposes of illustration and by way of example, the present invention provides for a folding work bench movable between a folded configuration or partially folded configuration and an unfolded configuration. As is illustrated in FIGS. 1-6, in a first presently preferred embodiment, the present invention provides for a folding work bench 30 movable between a folded configuration 32 or a partially folded configuration 33 and an unfolded configuration 34. The folding work bench folds compactly for storage, such as in a storage box 35 in the fully folded configuration as shown in FIGS. 1, 2 and 6, or against a wall in the partially folded configuration, as shown in FIGS. 8 and 12, when not in use. The folding work bench includes a durable, generally planar work table 36 having a top work surface 38 and an underside 40, and front 42, rear 44, left 46 and right 48 sides. The work table is movable between a folded position 50 extending in a longitudinal direction L, in either the folded configuration or partially folded configuration of the folding work bench, and an unfolded position 52 extending in a transverse direction T substantially perpendicular to the longitudinal direction in the unfolded configuration. The durable work table is currently typically formed with a laminated wood work surface, but may be formed of wood, durable plastic, metal, or similar suitable materials. As is illustrated in FIGS. 7-10, 12, 13 and 15-18, the work table optionally includes one or more sliding drawers 54 mounted to the underside of the work table, and typically includes a pair of the sliding drawers.

A plurality of front legs 56 are pivotally connected to the front side of the work table. In a presently preferred aspect, the folding work bench includes a pair of the front legs, which are compactly foldable against the underside of the work table in the folded configuration. The front legs optionally may include bottom folding end pieces 58, shown in FIGS. 1-6, 7-10, 12, 13 and 15-17, optionally may include an adjustable length telescoping upper portion and bottom portion, and optionally may be connected together by a cross-brace 64 shown in FIGS. 1-6.

The folding work bench includes a generally planar back board member 66 extending in the longitudinal direction and having a front side 68, a rear side 70, a top side 72 and a bottom side 74. The back board member includes a pair of first support struts 76 and a pair of second support struts 78 mounted to the bottom side of the back board member, with the pair of first support struts extending downwardly in the longitudinal direction from the bottom side of the back board member, and the pair of second support struts extending in the transverse direction from the bottom side of the back board member and pivotally connected to the left and right sides of the work table. In a presently preferred aspect, the back board member provides an area for placement of tools 79, and typically is formed of a peg board having a plurality of apertures 80 for the hanging of tools. Currently, the back board member typically is formed of a steel peg board, but the back board member may be formed of other materials such as a wood peg board, or a board with hooks or posts for example, or similar devices allowing for the placement of tools on the back board member.

The folding work bench also preferably includes a plurality of rear legs 82 pivotally connected to the pair of first support struts and movable between a rearwardly folded position 84 extending in the longitudinal direction adjacent to the back board member and an unfolded position 86 extending in a downwardly from the pair of first support struts in the longitudinal direction. Referring to FIGS. 8 and 12, the folding work bench can assume a partially folded configuration in which the rear legs are unfolded to support the folding work bench with the work table and front legs in their folded positions, so that the folding work bench can be stored in the partially folded configuration in a standing position against a wall, ready to be unfolded for use. The rear legs optionally may be connected by a cross brace 88 as shown in FIGS. 3-5, 8-10, 12, 13 and 15-17, and may include an adjustable length telescoping top portion 90 and bottom portion 92 as shown in FIGS. 8-10, 12, 13 and 15-17.

In a presently preferred aspect, the folding work bench also includes one or more articulated struts 94 each having first 96 and second 98 links pivotally connected together at pivot point 100. The first link is pivotally connected to one of the front legs, and the second link is connected to one of the first support struts. In a preferred aspect, a pair of the articulated struts is provided on opposing right and left sides of the folding work bench, and the articulated struts extend in the transverse direction when the work table is in the unfolded position, and extend in the longitudinal direction when the work table is in the folded position.

Figure 11:
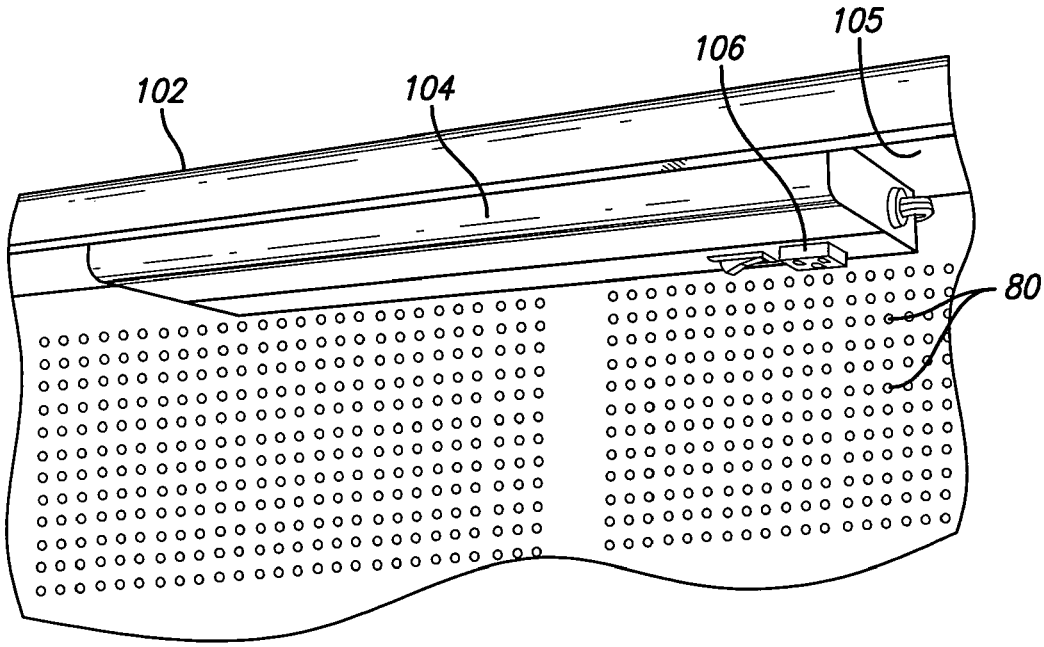
FIG. 11 is a perspective view of the fluorescent light and electrical outlet of the folding work bench of FIG. 7.

In another presently preferred aspect, the folding work bench includes a top storage shelf 102 mounted to the top side of the back board member and extending to the front in the transverse direction from the back board member. The top storage shelf may include a fluorescent light 104 mounted to the underside 105 of the top storage shelf, and an electrical outlet 106, shown in FIG. 11.

Figure 19:
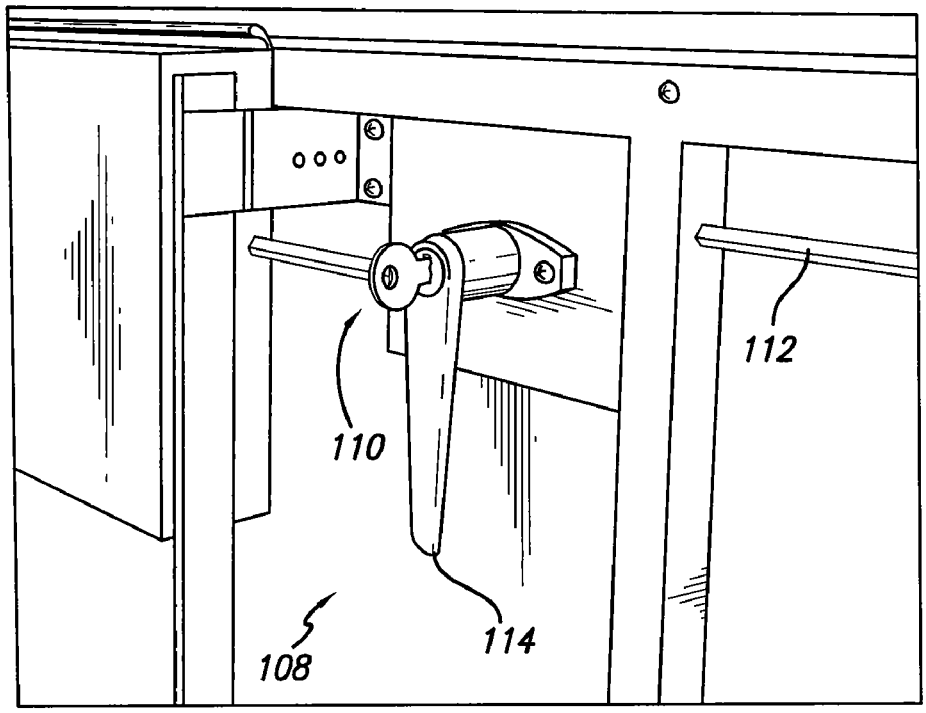
FIG. 19 is an enlarged view of the locking device of the folding work bench of FIG. 7.
Figure 20:
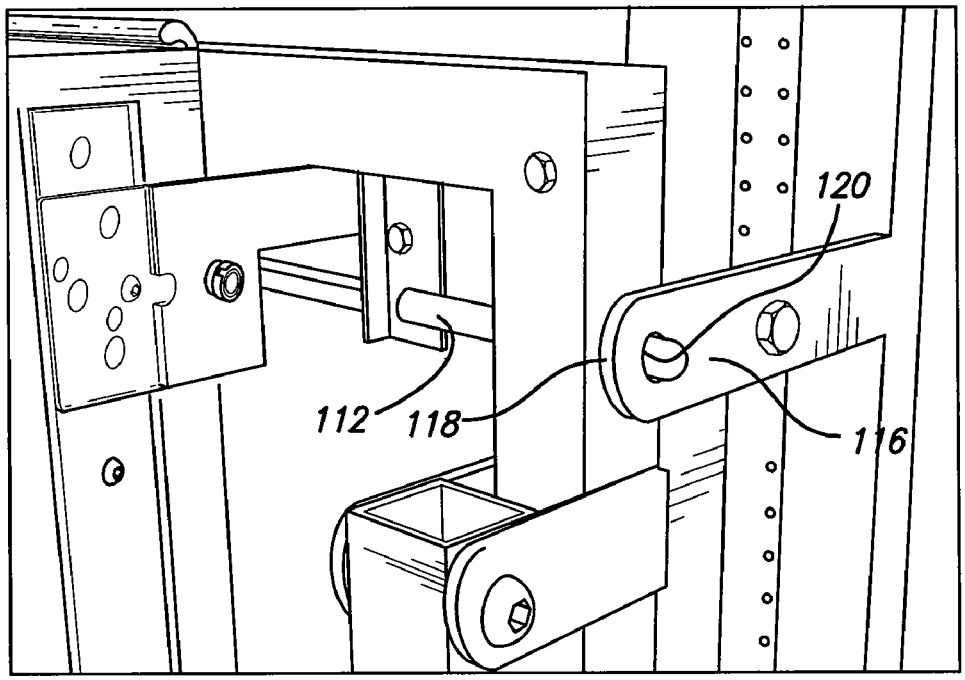
FIG. 20 is an enlarged view of a locking pin and locking strut of the locking device of the folding work bench of FIG. 7.

In another presently preferred aspect, the folding work bench includes a locking device 108 mounted to the underside of the work table, with a lock and key mechanism 110 shown in FIG. 19 for locking the work table in the folded position. The locking device typically includes a pair of opposing locking pins 112 connected to a rotatable locking handle 114. The locking pins are moveable between an inwardly withdrawn unlocking position and an outwardly extending locking position by turning the locking handle. A pair of opposing locking struts 116 are mounted to the left and right sides of the back board member and extend in the transverse direction toward the front of the folding work bench. Each of the opposing locking struts includes a forward end 118 with an aperture 120 for receiving the locking pins in their outwardly extending locking position. In this manner, tools on the back board member may be locked inside the folding work bench.

Figure 21:
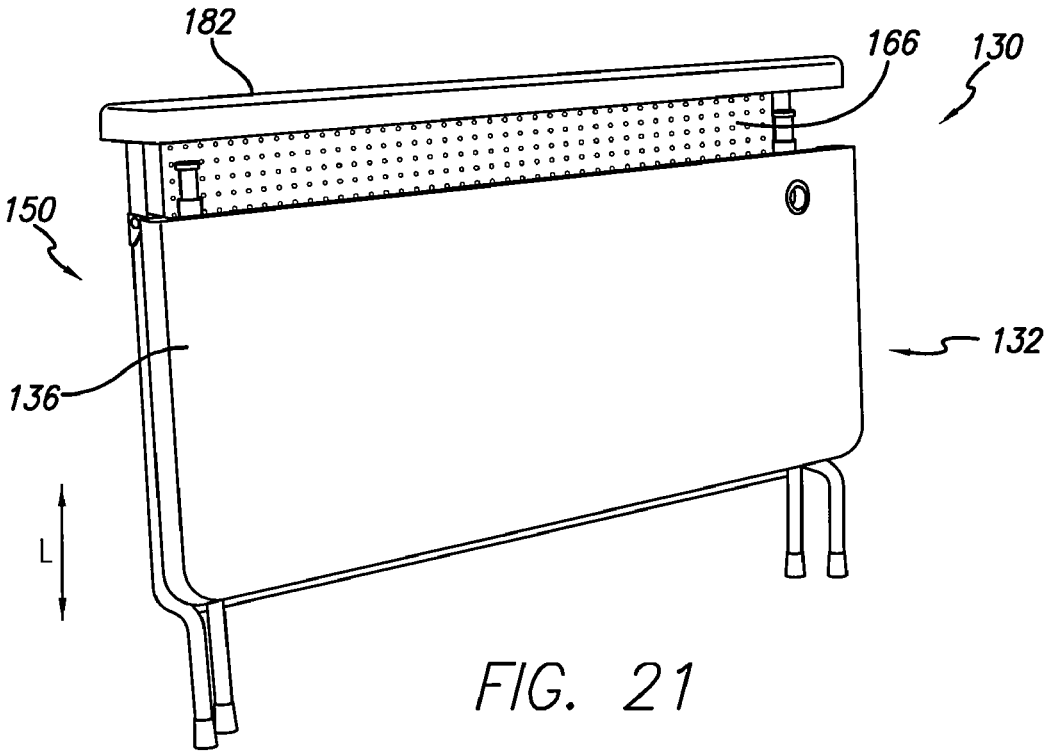
FIG. 21 is a perspective view of a second preferred embodiment of the folding work bench in a folded configuration, according to the invention.
Figure 22:
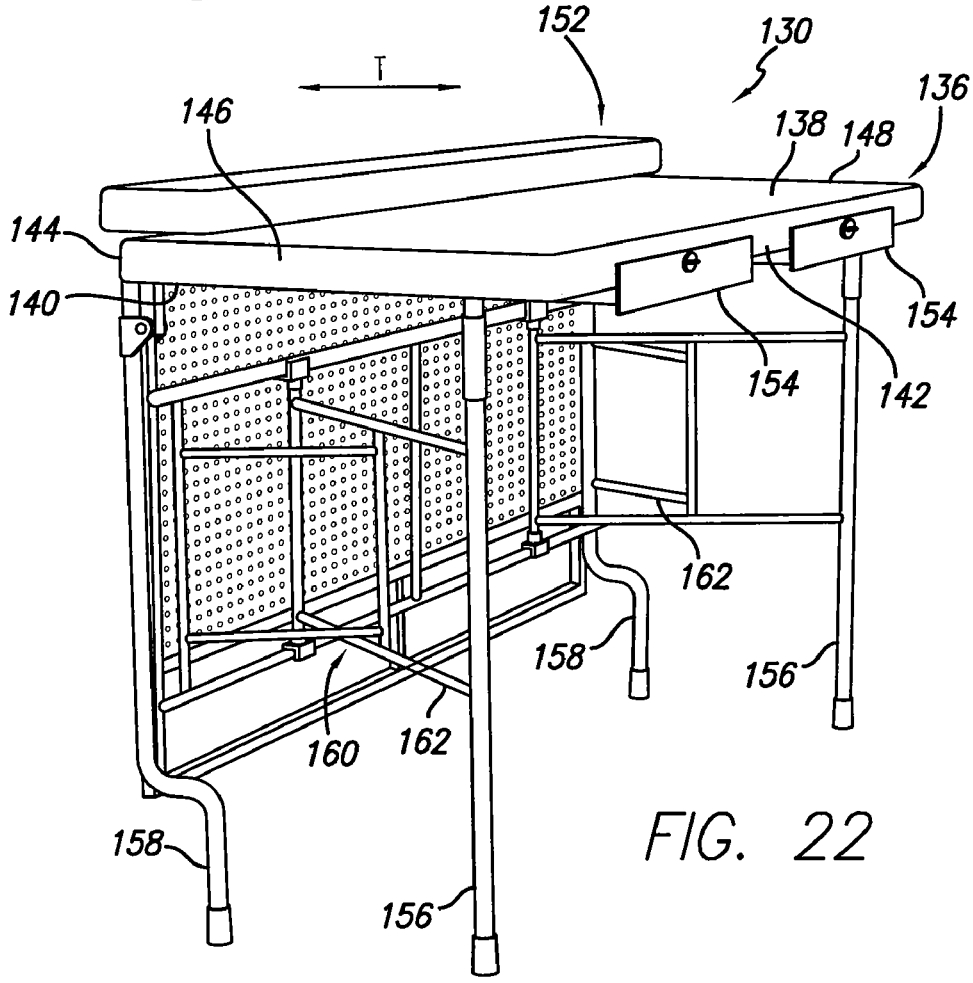
FIG. 22 is a perspective view of the folding work bench of FIG. 21 in an extended configuration.
Figure 23:
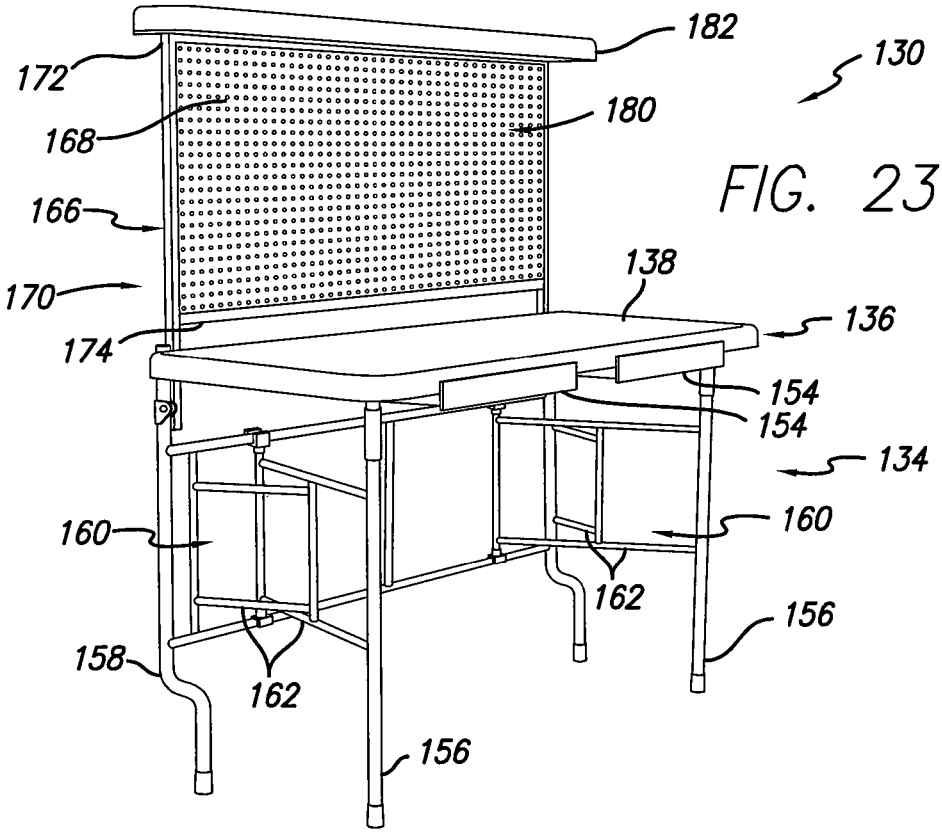
FIG. 23 is a perspective view of the folding work bench of FIG. 21 in an extended configuration with the peg board extended, stored against a wall.
Figure 24:
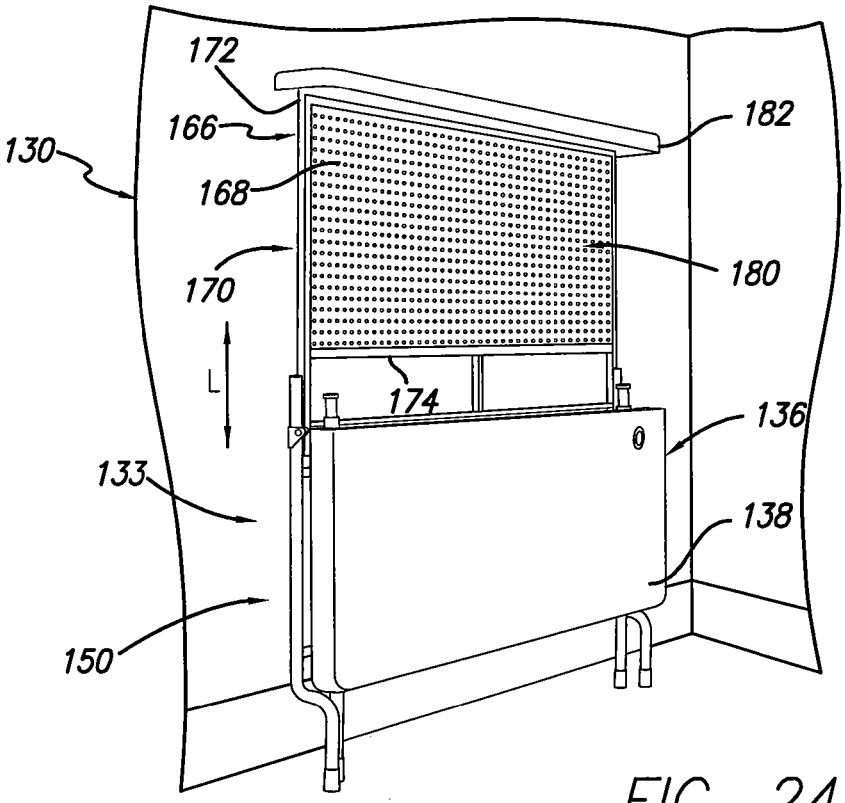
FIG. 24 is a perspective view of the folding work bench of FIG. 21 in a partially folded configuration with the peg board extended.
Figure 25:
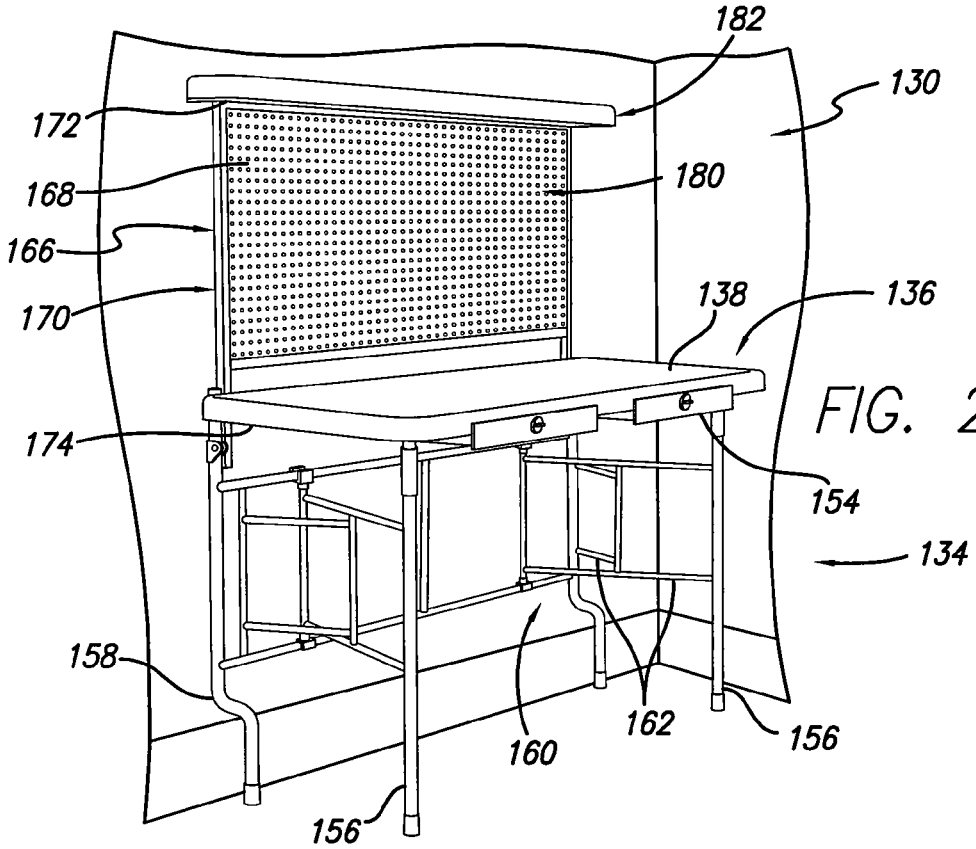
FIG. 25 is another perspective view of the folding work bench of FIG. 21 in an extended configuration with the peg board extended, against a wall.
Figure 26:
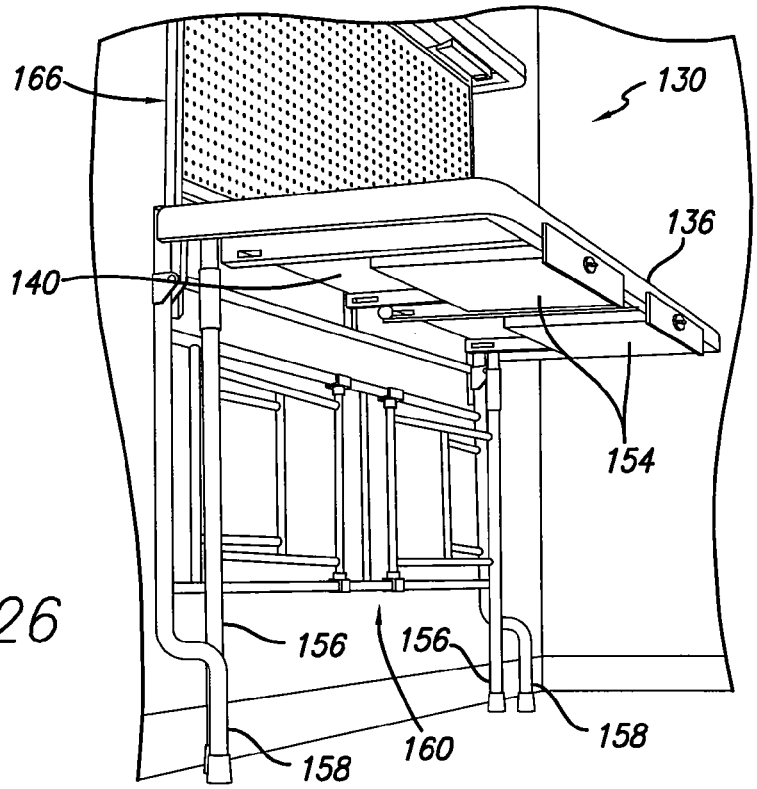
FIG. 26 is a perspective view of the folding work bench of FIG. 21 in a partially unfolded configuration with the front legs not deployed.
Figure 27:
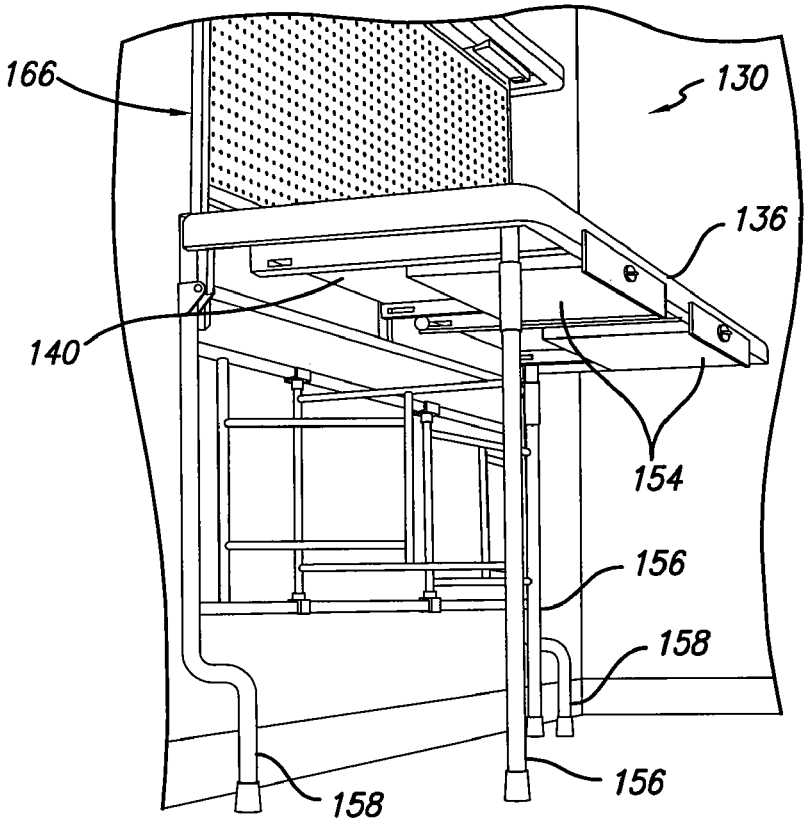
FIG. 27 is a perspective view of the folding work bench of FIG. 21 in an partially folded configuration, illustrating deployment of a front leg.
Figure 28:
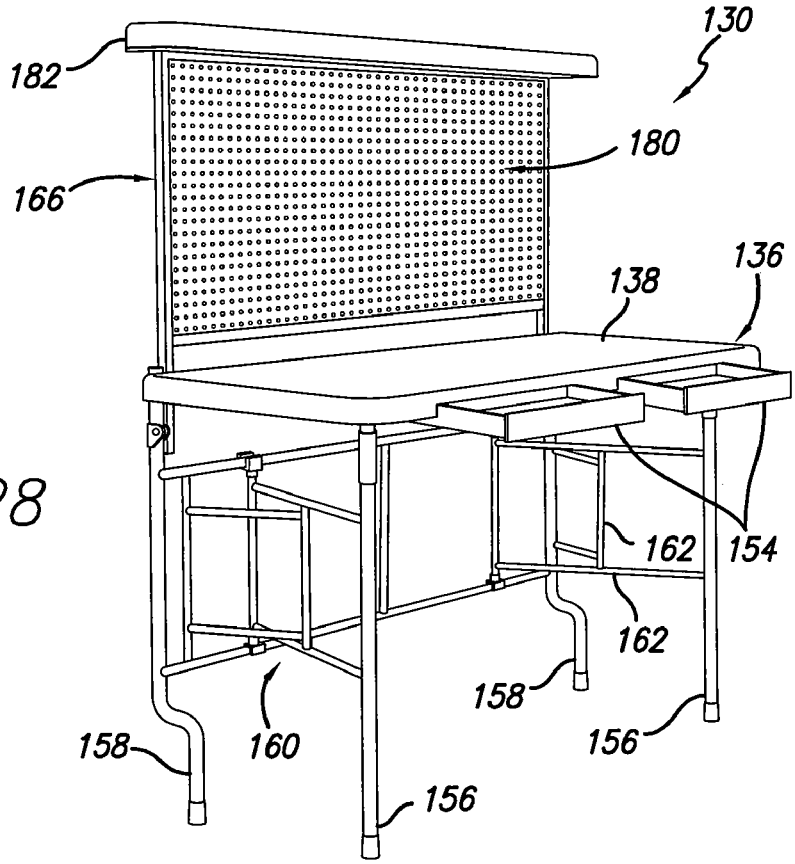
FIG. 28 is a perspective view of the folding work bench of FIG. 21 in an extended configuration showing the drawers open.
Figure 29:
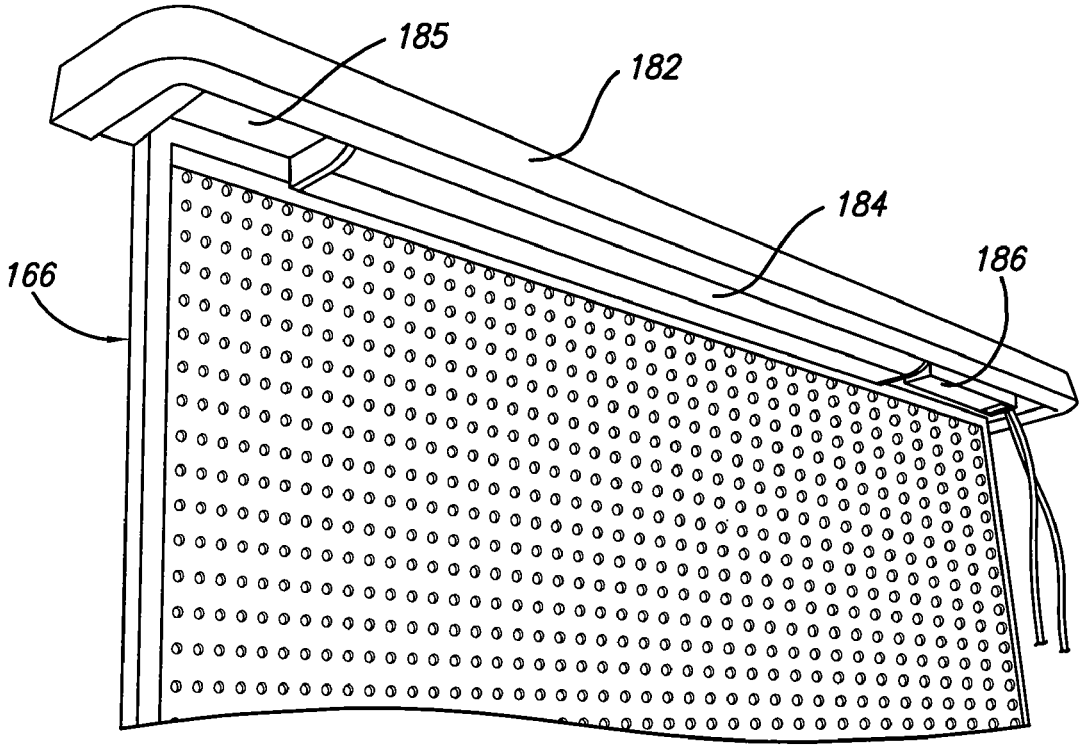
FIG. 29 is an enlarged perspective view of the upper shelf of the folding work bench of FIG. 21.

As is illustrated in FIGS. 21-29, in a second presently preferred embodiment, the present invention provides for a folding work bench 130 movable between a folded configuration 132 or a partially folded configuration 133 and an unfolded configuration 134. The folding work bench folds compactly for storage, as shown in FIG. 21, or against a wall in the partially folded configuration, as shown in FIG. 24, when not in use. The folding work bench includes a durable, generally planar work table 136 having a top work surface 138 and an underside 140, and front 142, rear 144, left 146 and right 148 sides. The work table is movable between a folded position 150 extending in a longitudinal direction L, in either the folded configuration or partially folded configuration of the folding work bench, and an unfolded position 152 extending in a transverse direction T substantially perpendicular to the longitudinal direction in the unfolded configuration. The durable work table is currently typically formed with a laminated wood work surface, but may be formed of wood, durable plastic, metal, or similar suitable materials. As is illustrated in FIGS. 22, 23, 25, 26, 27 and 28, the work table optionally includes one or more sliding drawers 154 mounted to the underside of the work table, and typically includes a pair of the sliding drawers.

A plurality of front legs 156 are slidably connected to the underside of the work table so as to be slidable between the front and rear sides of the table member. In a presently preferred aspect, the folding work bench includes a pair of the front legs, which are compactly folded against the underside of the work table in the folded configuration. A plurality of rear legs 158 are pivotally connected to the rear side of the table member, and the front legs are preferably pivotally connected to the rear legs by a truss assembly 160 of link members 162 pivotally connected together.

The folding work bench includes a generally planar back board member 166 extending in the longitudinal direction and having a front side 168, a rear side 170, a top side 172 and a bottom side 174. The back board member is preferably slidably connected to the rear legs, and is preferably lockable in the extended configuration, such as by detents. In a presently preferred aspect, the back board member provides an area for placement of tools, and typically is formed of a peg board having a plurality of apertures 180 for the hanging of tools. Currently, the back board member typically is formed of a steel peg board, but the back board member may be formed of other materials such as a wood peg board, or a board with hooks or posts for example, or similar devices allowing for the placement of tools on the back board member.

Referring to FIG. 24, the folding work bench can assume a partially folded configuration in which the rear legs are unfolded to support the folding work bench with the work table and front legs in their folded positions, so that the folding work bench can be stored in the partially folded configuration in a standing position against a wall, ready to be unfolded for use.

In another presently preferred aspect, the folding work bench includes a top storage shelf 182 mounted to the top side of the back board member and extending to the front in the transverse direction from the back board member. The top storage shelf may include a fluorescent light 184 mounted to the underside 185 of the top storage shelf, and an electrical outlet 186, shown in FIG. 29.

It will be apparent from the foregoing that, while particular forms of the invention have been illustrated and described, various modifications can be made without departing from the spirit and scope of the invention. Accordingly, it is not intended that the invention be limited, except as by the appended claims.

The invention claimed is:

1. A folding work bench movable between a folded configuration or partially folded configuration and an unfolded configuration, comprising:

a generally planar work table having a top work surface and an underside, and front, rear, left and right sides;

a plurality of front legs slidably connected to said generally planar work table;

a plurality of rear legs pivotally connected to said rear side of said generally planar work table;

a generally planar back board member extending in a longitudinal direction and having a front side, a rear side, a top side and a bottom side, said back board member slidably connected to said plurality of rear legs, and said back board member being slidably movable between an unextended configuration and an extended configuration, said back board member being in said unextended configuration when said folding work bench is in a folded configuration, and said back board member being in said extended configuration when said folding work bench is in an unfolded configuration or a partially folded configuration, whereby said folding work bench can be stored in said partially folded configuration in a standing position against a wall.

2. The folding work bench of claim 1, wherein said work table is movable between a folded position extending in said longitudinal direction and an unfolded position extending in a transverse direction substantially perpendicular to said longitudinal direction.

3. The folding work bench of claim 1, wherein said plurality of front legs are slidable between said front and rear sides of said generally planar work table.

4. The folding work bench of claim 1, wherein said front legs are pivotally connected to said rear legs by a truss assembly of link members pivotally connected together.

5. The folding work bench of claim 1, wherein said generally planar work table further comprises at least one sliding drawer.

6. The folding work bench of claim 1, wherein said back board member comprises a peg board.

7. The folding work bench of claim 2, further comprising a top storage shelf mounted to said top side of said back board member and extending in the transverse direction from said back board member.

8. The folding work bench of claim 7, wherein said top storage shelf includes a fluorescent light.

9. The folding work bench of claim 7, wherein said top storage shelf includes an electrical outlet.

* * * * *